United States Patent [19]

Kinnucan, Jr.

[11] 4,193,573

[45] Mar. 18, 1980

[54] CLIP-AND-SLEEVE ARRANGEMENT FOR USE WITH PAVING FORM AND TIE BAR

[76] Inventor: Walter F. Kinnucan, Jr., 140 Blackstone, LaGrange, Ill. 60525

[21] Appl. No.: 927,891

[22] Filed: Jul. 25, 1978

[51] Int. Cl.[2] ..... E01C 19/50

[52] U.S. Cl. ..... 249/9; 249/192; 249/205; 249/213; 404/47

[58] Field of Search ..... 249/205, 192, 9, 40, 249/61, 2, 207, 208, 213, 2, 3, 4, 5, 6, 7, 91, 177, 211; 404/47, 51

[56] References Cited

U.S. PATENT DOCUMENTS

| | | | |
|---|---|---|---|
| 963,431 | 7/1910 | Gates | 249/43 |
| 2,178,386 | 10/1939 | Bean | 249/9 |
| 2,262,859 | 11/1941 | Robertson | 25/118 W |
| 2,730,784 | 1/1956 | Salisbury | 249/9 |
| 2,745,165 | 5/1956 | Lewis | 249/9 |
| 4,030,693 | 6/1977 | Kinnucan | 249/9 |

FOREIGN PATENT DOCUMENTS

| | | | |
|---|---|---|---|
| 978482 | 12/1964 | United Kingdom | 249/9 |

*Primary Examiner*—Donald J. Arnold
*Attorney, Agent, or Firm*—James J. Jennings, Jr.

[57] ABSTRACT

A clip is disclosed for insertion in a hole in the side of a paving form. A paper sleeve, diamond-shaped or rectangular in cross section, covers one leg of a tie bar, and the sleeve is supported in the clip. After a slab is poured and the form is removed, the clip and hole identify the position of the tie bar, which is pulled outwardly in preparation for the next pour. The rectangular protective sleeve can be used without the clip, in that it positions the leg of the tie bar closely adjacent the paving form, without the interposition of extra concrete around the edges of the sleeve.

12 Claims, 14 Drawing Figures

CLIP-AND-SLEEVE ARRANGEMENT FOR USE WITH PAVING FORM AND TIE BAR

BACKGROUND OF THE INVENTION

There has long been a problem in the construction art of "tying" two slabs or adjacent paved areas together, when the slabs or areas are poured separately. By way of example, when a two-lane roadway is being poured, it is common practice to set up paving forms defining one lane of the roadway, pour the concrete into the forms to provide that lane or slab of pavement, remove the forms, and then place the forms at the other lane margin to pour the second slab or lane. When this is done, it is necessary to "tie" or join the adjacent slabs. This is conventionally done with reinforcing steel rods, generally called "tie bars" because they effectively tie the two slabs together. Such tie bars are generally about thirty inches in length, and a right angle bend is formed in the center so that the one leg of the tying bar can be inserted into the just-poured slab with the other leg of the bar parallel to—preferably abutting—the paving form. Thus after the slab sets up (hardens), the paving form can be removed and the other leg of the tie bar pulled outwardly to form a straight line with the first leg of the bar, already encased in the first slab. A problem has generally arisen in connection with providing easy access to the leg of the tie bar which parallels the edge of the slab after removal of the paving form.

One approach to locating and providing such access to the tie bar leg has included sliding a protective member, generally a sleeve of heavy paper or light cardboard, over the leg of the tie bar which abuts the paving form. This is usually done after the slab has been poured. Then the tie bar, with the protective sleeve around one leg, is inserted manually into the fresh concrete. It is pushed downwardly until it is parallel to and—hopefully—in contact with the paving form. Those skilled in the construction arts will appreciate the difficulty of properly positioning the tie bar and sleeve. After the paving form is removed, a pick is used to chip away concrete along the edge of the slab until the sleeve is located. The pick is then used to remove additional concrete and expose the leg of the tie bar, which is then bent outwardly in preparation for the second pour. Of course if the sleeve is not abutting the edge of the slab, or if it is not at substantially the proper height in the slab, this entails additional chipping away and increases the labor cost.

It is therefore a primary object of the present invention to provide an expeditious and economical support system for tie bars adjacent a paving form.

It is a more specific object of the present invention to provide such an improved arrangement which allows placement of the tie bars prior to pouring the concrete slab.

Another important object of the invention is the provision of a tie bar support arrangement which not only provides positive location of the tie bar, but also minimizes the amount of concrete which must be removed to afford access to the tie bar.

SUMMARY OF THE INVENTION

The present invention is particularly useful in combination with a paving form which defines an aperture. A support clip constructed according to the invention has hanger and restraining portions for retaining the clip in the aperture of the paving form. The clip further includes a support portion, which is itself connected between the hanger and restraining portions of the support clip. A conventional tie bar has a first leg, and a second leg which extends at substantially right angles to the first leg. A protective sleeve of paper or some similar material, which sleeve can be readily broken open to expose the tie bar after concrete is poured, substantially encloses the leg of the tie bar positioned adjacent the paving form. The protective sleeve enclosing the leg of the tie bar is received in the support portion of the support clip.

In accordance with another aspect of the present invention, the protective sleeve can be rectangular in cross section, so that one of the flat sides of the sleeve closely abuts the paving form and provides ready access to the encased leg of the tie bar after the form is removed. Moreover, the rectangular protective sleeve is useful even in those operations where a support clip is not used. That is, use of the particular rectangular configuration provides good contact of one side of the sleeve with the paving form, so that there is no significant amount of concrete preventing ready access to the encased leg of the tie bar after the paving form is removed.

THE DRAWINGS

In the several figures of the drawings, like reference numerals identify like components, and in those drawings.

DETAILED DESCRIPTION OF THE INVENTION

Figure 1:
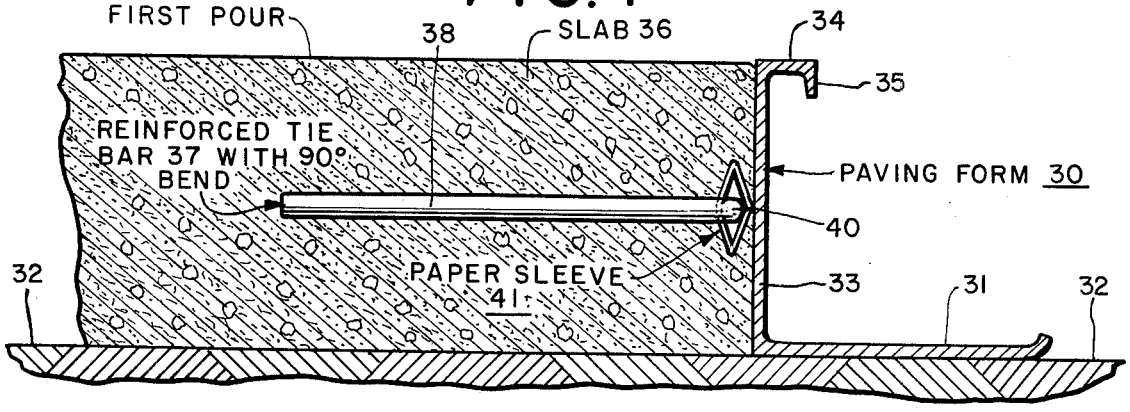
FIG. 1 is a side view of a prior art construction arrangement.

To better understand the invention, a description of the prior art devices used in this field will first be set out. As shown in FIG. 1, a paving form 30 has a base portion 31 resting on a flat road surface 32, a side wall portion 33 and an upper rail portion 34 which parallels the base portion 31. A depending portion 35 is affixed to the rail 34. Adjacent the paving form 30, and abutting the side wall 33, is a portion of a previously poured slab 36, which also rests on the road bed 32. A right-angle tie bar 37 includes a first leg 38 extending perpendicular to the paving form side wall 33, and a second leg 40 which extends at right angles to the first leg 38 and parallel the side wall 33. A sleeve 41, constructed of stiff paper (similar to light cardboard) encircles the leg 40 of the tie bar. It is important to note that sleeve 41 is generally in the shape of a parallelogram in cross section. For purposes of this explanation, and the appended claims, this parallelogram can be considered a diamond shape. The sleeve 41 is flexed and placed over the leg 40 after slab 36 has been poured, and then the tie bar 37, with the sleeve 41 covering leg 40, is inserted into the fresh concrete as shown. It is desirable that the tie bar and sleeve be positioned precisely as shown, so that the sleeve is not only parallel to, but also in contact with, the side wall 33 of the paving form. After the concrete has set up, paving form 30 is removed and the sleeve 41 is located by using a pick.

Figure 2:
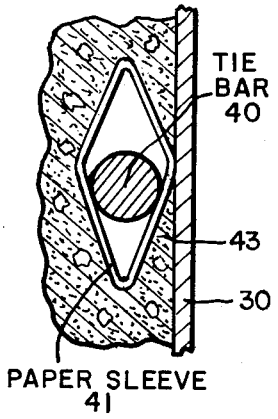
FIGS. 2, 3, 4 and 5 are partial side views, taken on a scale enlarged with respect to that of FIG. 1, useful in understanding problems in the prior art.
Figure 3:
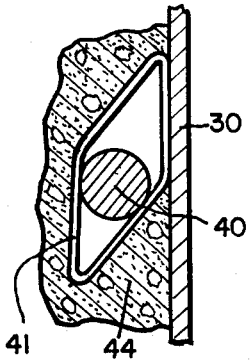
Figure 4:
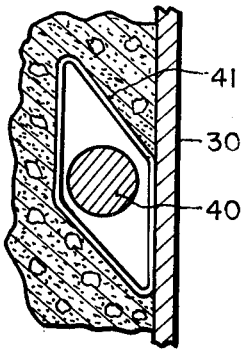

FIGS. 2, 3, 4 and 5 illustrate various positions in which the tie bar leg 40 and sleeve 41 are frequently found after insertion into the fresh concrete. FIG. 2 shows the ideal position, with the sleeve 41 actually abutting the form 30. Even with this idealized placement, the edge of the sleeve 41 is difficult to discern when the paving form is removed, and the location to begin chipping must be estimated. Moreover the leg 40 of the tie bar is positioned somewhat below the center of the sleeve, so that there is an area of concrete 43 in a wedge shap between the tie bar leg and the edge of the slab. This entire wedge of concrete must be chipped away to provide access to the tie bar. If, as shown in FIG. 3, the sleeve 41 is positioned with one surface parallel to and abutting the form 30, then the concrete wedge 44 which must be chipped out is much larger than that shown in FIG. 2 with the vertical orientation of the sleeve. When a different surface of the sleeve is flush against the form, as shown in FIG. 4, then there is still an intervening wedge of concrete which must be chipped away in order to pry out the tie bar.

Figure 5:
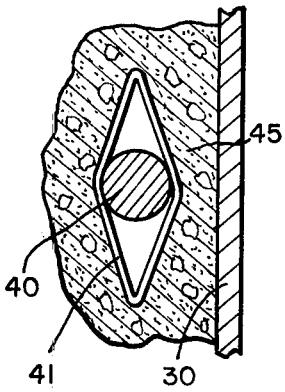

FIG. 5 depicts what frequently happens when the diamond-shaped sleeve 41 is utilized. As there shown the concrete 45, especially when vibrated, tends to work between the sleeve 41 and form 30, so that there is a significant layer of concrete masking the sleeve location when the form is removed. It will be appreciated this entails considerably more work by the laborer, endeavoring first to determine the location of the sleeve by chipping away concrete, and then removing sufficient concrete to have the tie bar bend outwardly. Thus all the orientations which may occur with the diamond-shaped sleeve presently in use have significant drawbacks.

Figure 6:
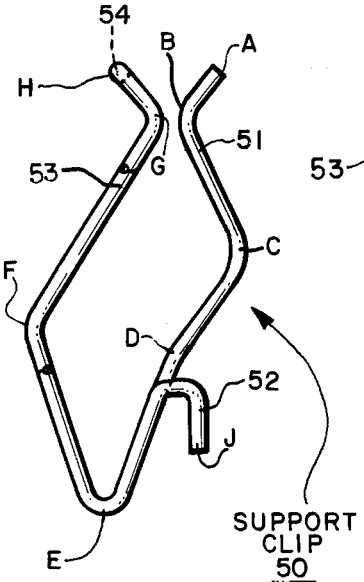
FIGS. 6 and 6A are side and front views, respectively, of a support clip constructed in accordance with the invention.
Figure 6A:
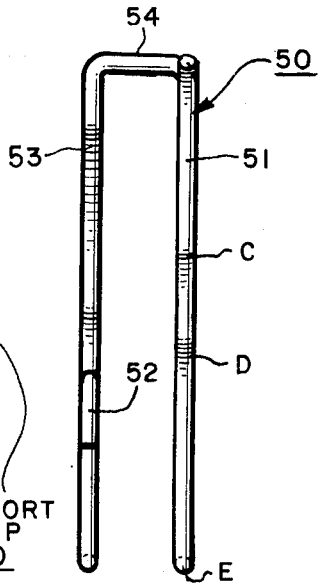

FIGS. 6 and 6A depict a clip 50, which is important to the inventive combination. In particular the support clip 50 facilitates placement of the tie bars prior to making the first pour. Support clip 50 includes an upper restraining portion 51, a lower hanger portion 52, and a support portion 53 which is, in effect, connected between the hanger and restraining portions. That is, the support clip can be formed from a single straight piece of spring steel wire, bending the wire to produce the desired shape. The wire is left straight from A to B, and then bent at an angle, from which it extends in a straight line to the point C. There the wire is bent again, and extends downwardly to D, where it is bent slightly as shown. The wire extends downward in a line to E, and then is bent as shown and extends up to point F. There the wire is bent up, and extends to point G and then deflected in a short arc up to the point H. At H the wire is bent at 90°, extends for the short distance 54 (FIG. 6A), is bent again at 90°, and then deformed to closely follow the path G, F, E, D. From D the last segment of the wire extends straight downwardly to point J, to complete the hanger portion.

Figure 7:
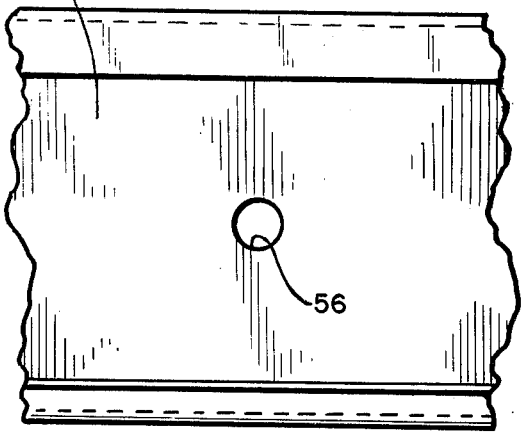
FIG. 7 is a front view of a paving form apertured to receive the support clip of FIG. 6.

To facilitate use of the clip, FIG. 7 shows that a paving form 55 defines an aperture 56 in approximately the position shown, corresponding to that at which the tie bar will be inserted. Those skilled in the art will understand that a longitudinal paving form will be apertured at about 30 inch intervals to provide for tie bars spaced at such intervals.

Figure 8:
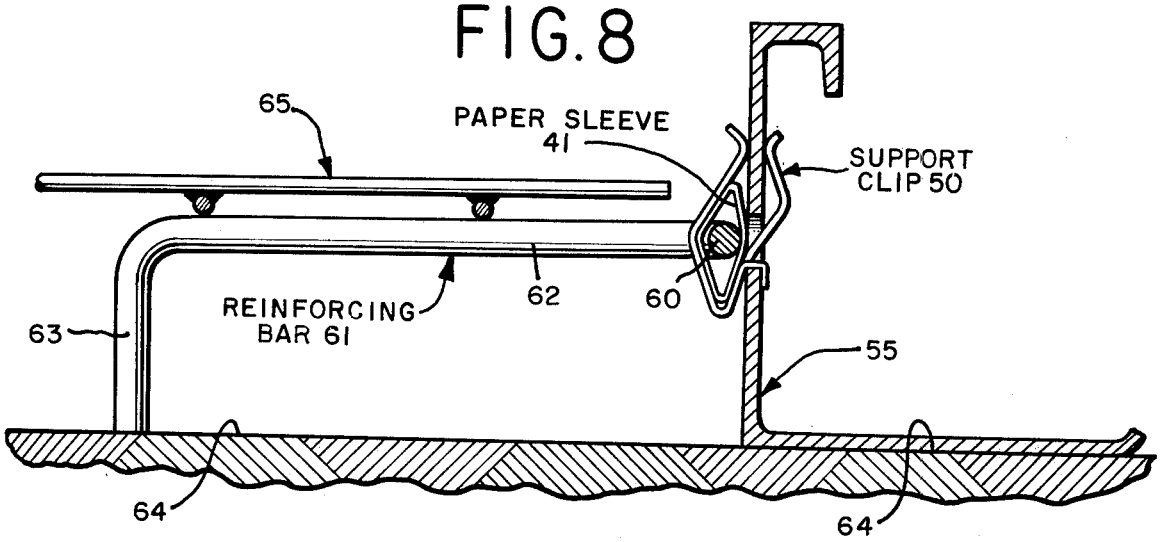
FIG. 8 is a side view of the support clip of the invention, used with a paving form and supporting a tie bar.

FIG. 8 indicates how the combination of the invention permits placement of the tie bars prior to the pour. As there shown, the paving form 55 has a support clip 50 therein, and a paper sleeve 41 is received in the support clip. The paper sleeve surrounds one leg 60 of a reinforcing tie bar 61, which extends at substantially right angles to its other leg 62. The extremity 62 of leg 62 is bent at right angles, both to leg 62 and to leg 60. This allows the leg portion 63 to engage the ground 64 and afford proper positioning of the end of reinforcing bar 61 which is remote from the leg 60 supported in sleeve 41 and clip 50. It is thus manifest that the inventive combination not only provides easy and rapid placement of the tie bars prior to pouring the concrete, greatly reducing the time and hence the labor cost, but also reduces the time and labor cost in locating the tie bar after the paving form is removed.

Another significant advantage flows from setting the tie bars in place prior to pouring. The bars thus positioned provide a good support for a reinforcing mesh 65, which can also be placed prior to pouring. Otherwise the mesh must be positioned on top of newly-poured concrete, and either walked down by the feet of laborers or displaced by vibrating equipment to approximately the proper depth. Thus the invention not only facilitates placement of the tie bars (and the mesh, when used) before pouring, but also effects precise positioning of these components at the proper location.

Figure 9:
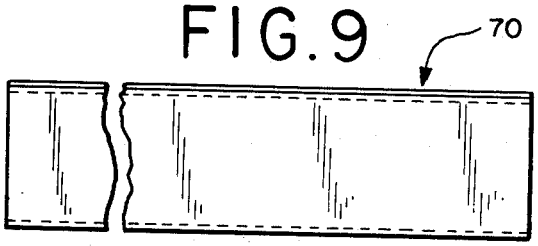
FIGS. 9 and 10 are front and side views, respectively, of a protective sleeve developed as one aspect of the present invention.
Figure 10:
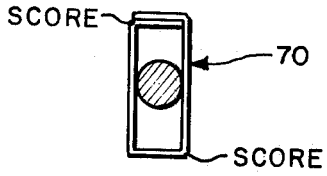

While the unobvious support clip of the invention used in conjunction with the presently-employed diamond-shaped paper sleeves provides a significant advance in this art, the efficacy of the invention can be significantly enhanced by utilizing a paper sleeve which is substantially rectangular in cross section, as shown in FIGS. 9 and 10. Indeed it will become apparent that the sleeve depicted in FIGS. 9 and 10 has substantial utility by itself, as an improvement over the presently-used diamond-shaped sleeve, even without the support clip arrangement of the present invention.

FIG. 9 shows in side view a rectangular paper sleeve 70, and FIG. 10 depicts the same sleeve in an end view. The sleeve can of course be made from flat stock, with scores in the positions indicated to facilitate folding the flat stock into the desired shape. There is an overlap at one of the surfaces, the top surface as shown in FIG. 10, to provide for gluing of the two ends and thus producing the rectangular paper sleeve. In the preferred embodiment, the sleeve 70 was about fifteen inches long to substantially enclose one end of a tie bar, about $1\frac{1}{8}$ inches in height and $\frac{1}{2}$ inch in width.

Figure 11:
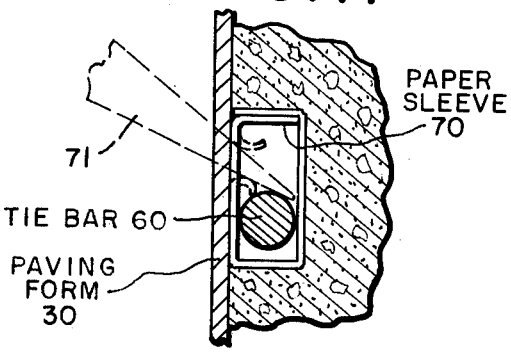
FIG. 11 is a side view, useful in understanding the advantages of the sleeve depicted in FIGS. 9 and 10.

FIG. 11 illustrates a substantial advantage of using the rectangular sleeve 70 by itself, without the support clip. As there shown, when the sleeve 70 substantially encloses one leg 60 of a tie bar, and the sleeve-and-bar combination is worked down into the concrete to the proper placement, the paper sleeve 70 virtually abuts a substantial portion of the paving form 30. This prevents the entry of any concrete between the form 30 and the sleeve 70, because of the substantially flat surface adjacent the paving form. Hence it is manifest that the use of the rectangular paper sleeve—that is, rectangular in cross section—by itself can provide a substantial improvement in the construction art, by simplifying the removal or bending outwardly of the tie bar leg. FIG. 11 depicts the simple entry of a pick 71 through the substantial area on the one side of the paper sleeve 70, to facilitate removal of the tie bar leg without chipping away a significant amount of concrete.

Figure 12:
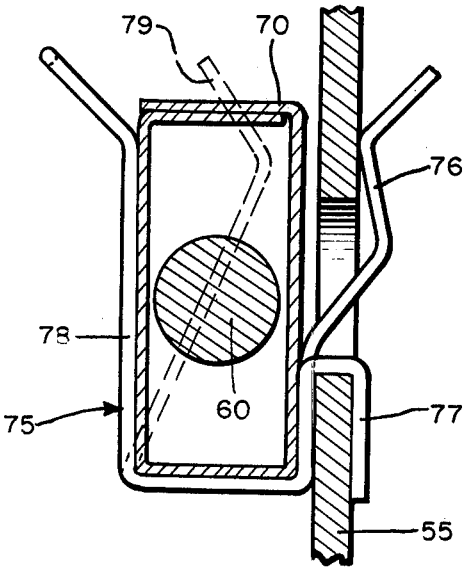
FIG. 12 is a side view of another support clip, modified to receive the protective sleeve illustrated in FIGS. 9 and 10.

FIG. 12 illustrates use of the rectangular sleeve 70 with a support clip 75, which differs from the support clip 50 in that its configuration has been modified to accommodate the rectangular sleeve. In a manner similar to the support clip 50, the clip 75 includes a restraining portion 76 for providing a force agsinst the form 55, and thus forcing the sleeve-and-tie bar against the form. The clip also includes a hanger portion 77 for fitting over the lower lip of the aperture in the paving form, and a support portion 78 for receiving and supporting the sleeve in the position illustrated. Broken line 79 depicts the position of a part of the support portion 78 of the clip, when the clip is not under tension, prior to placing the upper sleeve and tie bar in position. The angle bend in the uppermost portion of the support portion of the clip facilitates easy insertion of the rectangular sleeve. Because it is not always possible to work the sleeve into the desired position as shown in FIG. 11, considering the difficulty encountered by laborers as explained above, the only positive means for positioning and maintaining the sleeve-and-tie bar arrangement in the desired position is that shown in FIG. 12. Thus this figure illustrates the best mode known for practicing the invention at the present time.

Figure 13:
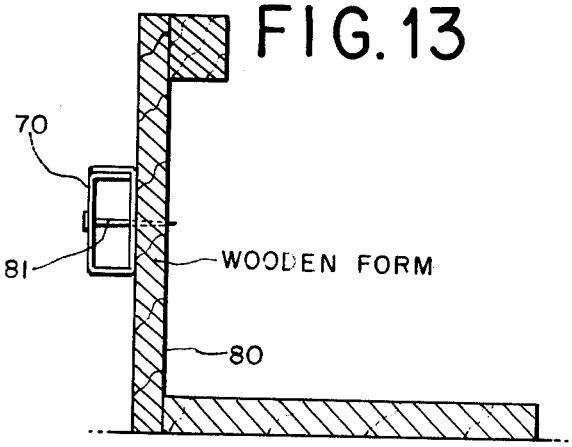
FIG. 13 is a side view, showing the protective sleeve of FIGS. 9 and 10 supported against a wooden form.

On occasion wooden paving forms are used for smaller-scale jobs, and when constructing curved pavement. When this is done, it is not necessary to provide apertures in the paving form, as has been described above in connection with the support clips. Instead, FIG. 13 illustrates the use of a wooden paving form 80, and a pair of nails 81,81 (only one of which is visible in this view) driven into the wooden form to support the rectangular sleeve 70 as shown. The heads of the nails just touch the side of the rectangular sleeve as indicated. The leg of the tie bar can fit either above or below the nails 81. Accordingly this is another use of the rectangular sleeve described previously in connection with FIGS. 9 and 10.

TECHNICAL ADVANTAGES

When the support clip of the invention is used in conjunction with an apertured paving form, the tie bar (in the protective sleeve) is supported at the desired height in the concrete slab, or in any other material. In particular the tie bar and sleeve are held snugly against the paving form during the placement and vibration of the concrete, ensuring that concrete is not deposited between the tie bar and the paving form. This means there will be no concrete to be chipped away with a pick or other instrument after the paving form is removed, and provides a larger void when the form is removed to ensure easy access to the tie bar.

The support clip is easy to insert, having a hanger or inverse-U portion in the lower part of the clip which fits over the form at the bottom of the aperture, thus supporting the clip itself. The reverse bend in the upper portion of the support clip provides a pressure against the form, and thus acts as a restraining force so that the support portion of the clip (which receives the sleeve) is maintained in position abutting the paving form.

When the protective sleeve is rectangular in cross-section, it provides significant advantages even without the support clip. The rectangular configuration enables one surface of the sleeve to rest flush against the paving form, thus precluding the deposition of concrete between the form and the protective sleeve. This also facilitates location of the sleeves and tie bars after the form is removed, to simplify the bending out of the tie bar leg. in addition the rectangular sleeve finds use with wooden or composition paving forms, as the sleeve can be supported by two nails or other fasteners in the desired position.

While only particular embodiments of the invention have been described and claimed herein, it is apparent that various modifications and alterations of the invention may be made. It is therefore the intention in the appended claims to cover all such modifications and alterations as may fall within the true spirit and scope of the invention.

What is claimed is:

1. The combination of a paving form containing apertures and:

a support clip, having hanger and restraining portions for retaining the clip in one of the form apertures, and a support portion connected between the hanger and restraining portions;

a tie bar, having a first leg and a second leg extending at substantially right angles to the first leg; and a protective sleeve, substantially enclosing one leg of the tie bar and received in the support portion of the support clip, which sleeve is formed of a material readily broken open to expose the tie bar after concrete is poured on the other side of the sleeve.

2. The combination of claim 1, in which the support clip hanger portion is formed to extend over both sides of the paving form, just below the aperture, thus maintaining the protective sleeve and tie bar in a predetermined position.

3. The combination of claim 1, in which the support clip restraining portion is formed to provide a force against the paving form, thus forcing the protective sleeve and tie bar against the form.

4. The combination of claim 1, in which the protective sleeve is rectangular in cross-section.

5. The combination of claim 1, in which the protective sleeve is diamond-shaped in cross-section.

6. The combination of claim 4, in which the support portion of the protective sleeve is formed to accommodate the rectangular protective sleeve.

7. The combination of claim 5, in which the support portion of the protective sleeve is formed to accommodate the diamond-shaped protective sleeve.

8. The combination of a paving form containing a plurality of apertures, spaced at intervals along the form:

a support clip, having hanger and restraining portions for retaining the clip in one of the form apertures, and a support portion connected between the hanger and restraining portions, said hanger portion being shaped generally like an inverted U, and said restraining portion providing a force against the paving form, to maintain the protective sleeve abutting the form;

a tie bar, having a first leg and a second leg extending at substantially right angles to the first leg; and a protective sleeve, substantially enclosing one leg of the tie bar and received in the support portion of the support clip, which sleeve is formed of a material readily broken open to expose the tie bar after concrete is poured on the other side of the sleeve.

9. The combination of claim 8, in which the protective sleeve is rectangular in cross-section.

10. The combination of claim 8, in which the protective sleeve is diamond-shaped in cross-section.

11. The combination of claim 9, in which the support portion of the protective sleeve is formed to accommodate the rectangular protective sleeve.

12. The combination of claim 10, in which the support portion of the protective sleeve is formed to accommodate the diamond-shaped protective sleeve.

* * * * *